US005411165A

United States Patent [19]

Ellis

[11] Patent Number: 5,411,165

[45] Date of Patent: May 2, 1995

[54] DRAWER AND INSERT FOR RAPID REMOVAL OF VALUABLES

[76] Inventor: Thomas J. Ellis, 5407 E. Libby St., Scottsdale, Ariz. 85254

[21] Appl. No.: 124,707

[22] Filed: Nov. 2, 1993

[51] Int. Cl.[6] ..... B65D 25/16

[52] U.S. Cl. ..... 220/404; 220/403; 383/33; 383/75; 383/11; 312/330.1

[58] Field of Search ..... 383/33, 75, 11; 312/330.1, 348.3, 348.5; 220/404, 403, 461

[56] References Cited

U.S. PATENT DOCUMENTS

| | | | |
|---|---|---|---|
| 1,608,901 | 11/1926 | Miller | 220/404 |
| 1,653,556 | 12/1927 | Faber | 220/404 |
| 1,907,082 | 5/1933 | Meltzer | 220/404 |
| 1,938,452 | 12/1933 | Griesmeyer | 220/404 |
| 2,318,952 | 5/1943 | Martin | 220/404 |
| 3,443,971 | 5/1969 | Wood | 220/404 |
| 3,576,290 | 4/1971 | Marchisen | 220/404 |
| 3,940,052 | 2/1976 | McHugh | 220/404 |
| 4,139,037 | 2/1979 | McGuigan | 383/11 |
| 4,674,127 | 6/1987 | Yamada et al. | 220/404 |
| 5,176,315 | 1/1993 | Homel | 220/404 |

FOREIGN PATENT DOCUMENTS

| | | | |
|---|---|---|---|
| 2164547 | 3/1986 | United Kingdom | 383/33 |

*Primary Examiner*—Stephen J. Castellano
*Attorney, Agent, or Firm*—James F. Duffy; Richard R. Mybeck

[57] ABSTRACT

A system providing rapid and efficient evacuation of valuables from a storage site such a home or office. Such rapid evacuation is often required in the face of impending disaster. A storage container, for example a drawer, is provided with an inner lining. Valuables are stored on the lining within the drawer. The lining itself is an open carrier having side walls which are folded so as to configure the liner to the drawer. In the case of emergency evacuation, the side walls of the liner are rapidly unfolded by grasping draw strings which act to remove the liner from the drawer and to close the liner to provide a closed transport carrier for the valuables stored within the drawer.

17 Claims, 1 Drawing Sheet

DRAWER AND INSERT FOR RAPID REMOVAL OF VALUABLES

BACKGROUND

1. Technical Field of the Invention

The invention relates to means for the rapid removal of valuables from their place of storage in cases of emergency. In particular, the invention relates to a liner for a storage container in which valuables are stored. The liner converting to a transport carrier permitting the near instant removal of the valuables from a storage container and transport of these valuables away from the storage site. Typically, the invention relates to an open top, flexible carrier which conforms to the interior of the drawer as a liner thereof. Valuables stored within the drawer may be removed with the liner and carried away in the liner.

2. Prior Background Art

Tragedies make headlines. Frequently these headlines describe disasters caused by earth quakes, hurricanes, fire, flood, tornado and the like. Often persons have warning of impending disaster and must rush to remove valuables from their homes and offices to take them from harms way. At other times disaster strikes so that there is no time to salvage valuables. However, in such cases authorities often allow persons to reenter buildings for rapid salvage purposes. Such an instance would be after an earthquake when the knowledge that aftershocks will follow encourages persons to reenter houses endangered or slightly damaged by the initial quake to secure and remove valuables.

It should be noted that in referring to "valuables," the term is intended to cover items of intrinsic value as well as items which were only valuable in the subjective appraisal provided by the owner. Thus, items such as family photo albums, inexpensive jewelry that belonged to ancestors or parents, and items associated with personal experiences such as engagements, weddings, birth of children, and the like are deemed to be "valuables" herein. Valuables also include items such as computer files, important documents such as birth and marriage certificates, certificates of ownerships of automobiles and deeds of homes. In cases of emergency, valuables may well include the necessary clothing, medication, and toiletries to be used in the days immediately following a disaster.

In disaster stories printed in publications persons stricken by disaster often lament more the loss of family photographs and other items of sentimental value than they do the destruction of their home. The home after all is frequently covered by insurance; and a new home may be built. But a sentimental keepsake or other personal item is generally irreplaceable.

Ask a person where they store their valuables. You may hear comments such as, "Well, my personal papers, insurance policies, automobile registrations, birth certificates, things like that, I keep in the bottom drawer of my dresser. We've got all our family photos in the drawer of the end table in our living room. And, I keep all of my computer files on the support shelf in the cabinet just under my computer." Were there to be an impending disaster requiring evacuation of that person from his premises and the immediate area, he would have to pack the various documents from the lower drawer of his dresser, gather up the photos from the drawer of the end table in the living room, and package the various computer documents from the shelf in the cabinet under his computer. To find something to package this material, to actually go through the act of packaging it, and then to carry the materials out to the car might consume valuable time which would be better utilized in distancing that person from the site of the impending disaster.

It is an objective of the invention to provide the means whereby a person may find his valuables virtually packaged for evacuation and transport at all times and yet be readily accessible for use under normal circumstances.

SUMMARY DESCRIPTION OF THE INVENTION

The invention may be summarized as a system for rapid evacuation of storage container contents. The system itself includes a storage container in which valuables are stored and accumulated. A flexible, closable, open top carrier lines the interior of the container. The stored and accumulated valuables lie within this carrier within the container. There are means coupled to the carrier for rapidly closing the open top carrier and removing the carrier from the storage container with the valuables secured for transport.

In a presently preferred embodiment the storage container is a drawer.

The carrier has interior dimensions generally exceeding the interior dimensions of the storage container. There are folds in the carrier generally conforming the carrier to the interior of the storage container.

The carrier is, preferably, a closable, open top sack having an enclosing side wall and a bottom. The storage container has a support surface for supporting the valuables therein. The bottom of the sack has a shape generally conforming to the shape and size of the support surface.

The storage container has a side containment wall. The enclosing side wall of the sack has a height exceeding the height of the side containment wall of the storage container. Folds in the enclosing side wall of the sack, conform the sack to the storage container.

The means for rapidly closing the open top carrier comprises a draw string encompassing the open top of the sack for drawing the open top closed and for lifting the sack from the storage container with the valuables within the sack.

DETAILS OF BEST MODE FOR CARRYING OUT THE INVENTION

Figure 1:
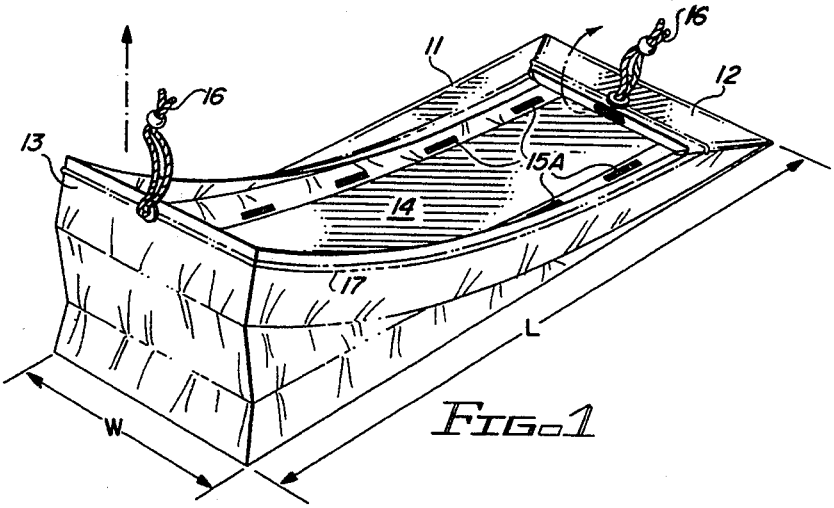
FIG. 1 is a perspective drawing of the valuables transport carrier of the invention showing the right, uppermost end of the carrier in its as-provided, folded condition and the left, lowermost end of the carrier in its extended upright position as would be suitable for transport of valuables.

For purposes of promoting an understanding of the principles of the invention, reference will now be made to the embodiments illustrated in the drawings and specific language will be used to describe same. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

The invention comprises, in substance, a storage container for storing valuables and a liner for lining the storage container prior to the injection of valuables into the container. The liner serves as an emergency transport carrier for the valuables permitting them to be removed en masse in the course of an emergency evacuation. For purpose of exposition and not of limitation, the storage container exemplified in the drawings and disclosure here is a drawer such as might be found in a bedroom dresser or other like item of furniture. The overall concept of the invention is applicable, however, to containers of various sizes, shapes and utility. A presently preferred embodiment of the transport carrier 11 is shown in FIG. 1.

Carrier 11 is a soft, flexible open top container. As provided, it is folded flat, as indicated at the upper right end of the illustration of FIG. 1. Carrier 11 has a length L, and a width W selected to conform to the interior dimensions of a drawer where valuables are to be stored. If right end 12 of carrier 11 is folded upward as indicated by the curved arrow, and the remaining sides adjusted upward as well, a low walled rectangular container results as illustrated in FIG. 2. The low walled structure will fit downward into a drawer to form a liner for the drawer.

Figure 2:
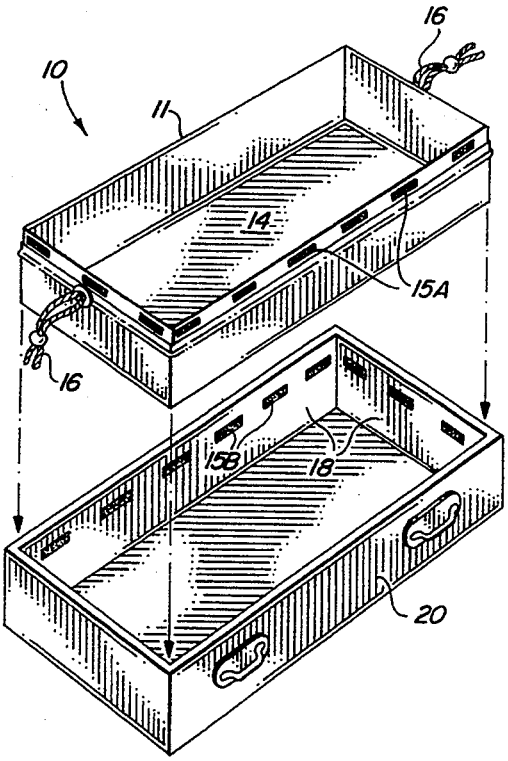
FIG. 2 is an exploded assembly view of the invention comprising the valuables carrier and a storage container depicted here in the form of a drawer.
Figure 3:
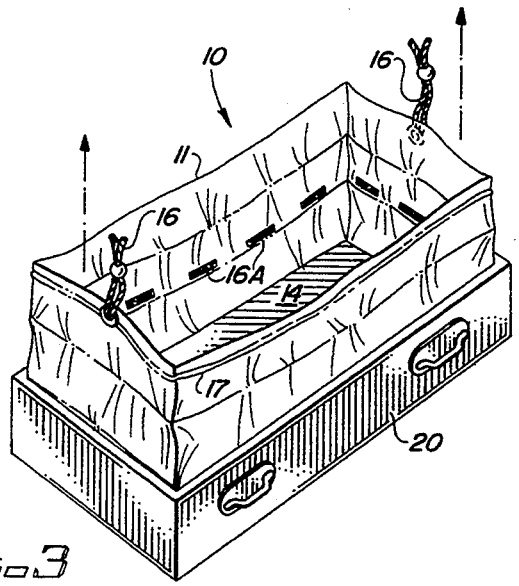
FIG. 3 is a perspective view of the invention with the carrier ready to be moved from the drawer container, the size of the carrier having been extended in preparation for enclosing the valuables contained therein.

If the left end 13 of carrier 11 is drawn upward to fully extend the left end wall of carrier 11, for example by drawing upward on draw string 16 indicated by the arrow at the left end of FIG. 1, a rectangular vessel with high walls, as illustrated in FIG. 3, results.

Carrier 11 has a bottom 14 which will rest on the bottom of the drawer in which the valuables are stored and the valuables will be placed atop bottom 14 of carrier 11. Along a fold of the interior walls of carrier 11 are placed a plurality of fasteners 15A each comprising a part of a hook and loop assembly 15 (not shown). Fasteners 15A will mate with complementary fasteners 15B within the storage container in which carrier 11 will be placed.

To provide for the closure of carrier 11 drawstrings 16 are fed within a hem 17 about carrier 11. Drawstrings 16 also provide for the rapid removal of the carrier from its container as well as for the closure of the carrier.

The system 10 of the invention is shown in FIG. 2. Carrier 11 has been unfolded to the extent of forming a low walled rectangular container which fits downward inside of drawer 20. Drawer 20 will be the storage container for valuables. The side walls of carrier 11 contain those folded portions which are seen at the leftmost end of FIG. 1. These folded portions lie below fasteners 15A which are exposed along the peripheral wall of FIG. 2. Complementary fasteners 15B are positioned along sidewalls 18 of drawer 20 in positions such that each of the plurality of fasteners 15A on carrier 11 will mate with its complementary fastener 15B on the side walls 18 of drawer 20. When fasteners 15A and 15B mate, a hook and loop fastener assembly 15 is formed. The assembly 15 is not shown. It is provided with a reference for its expository purposes. Hook and loop fasteners are well known in the fastening art.

When the low walled configuration of carrier 11 is placed within drawer 20 and the fasteners 15A and 15B are matingly coupled, a liner for drawer 20 results. The exposed draw strings 16 may be placed between side walls 18 of drawer 20 and the sides of carrier 11 or may be allowed to extend upward and over into the drawer where there are visible and readily accessible. In general, the assembly of carrier 11 and drawer 20 of FIG. 2 presents the appearance of a conventional drawer with an inner liner. Preferably carrier 11 is made of a flexible weatherproof fabric.

Figure 4:
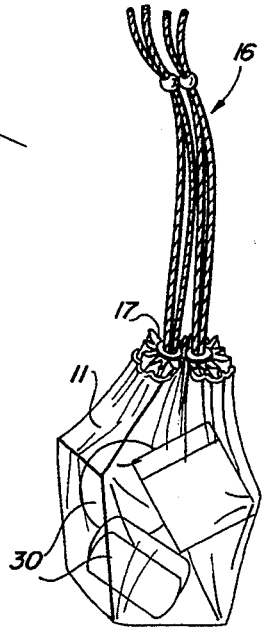
FIG. 4 shows the carrier removed from the drawer and containing valuables ready for transport.

As noted in the discussion of FIG. 1, fasteners 15A are affixed to the inner wall of carrier 11. Thus, when one draws rapidly upward on draw strings 16, the folded portions of carrier 11 begin to unfold. As the walls of carrier 11 move upward they create a separating pressure between fasteners 15A and 15B causing the assembled hook and loop fastener 15 to decouple into its components parts 15A and 15B. The walls rise upward until a high walled carrier 11 of FIG. 3 results. Any valuables which were stored within drawer 20 will now be contained within the high walled vessel depicted in FIG. 3. Continued exertion on draw strings 16 will cause the closure of carrier 11 in the manner indicated in FIG. 4. Carrier 11 now forms a closed carrier which may be suspended by draw strings 16 and transported from the site at which the valuables 30 now contained within carrier 11 may be rapidly transported.

The terminology of "draw strings" has been used to describe the means for closing and transporting carrier 11. In practice, draw strings 16 preferably consists of a nylon rope or the like well capable, in co-operation with carrier 11, of transporting more than sixty pounds of material.

Carriers 11 may be made up in various sizes to conform to the dimensions of several selected drawers at a storage site, such as a home or office. Thus, in the case of emergency, a person need move only to the drawers in which valuables are stored, grasp the draw strings 16, pull upward and inward to remove carrier 11 from its coupling of drawers 20 and close the top of the carrier 11. Continuing to grasp draw strings 16 the person travels away from any given one of drawers 20 to the next drawer containing valuables and repeats the action there. A plurality of carriers closed and containing valuables may be rapidly removed from the storage site in this manner.

What has been disclosed is a system providing rapid and efficient evacuation of valuables from a storage site such as a home or office. Such rapid evacuation is often required in the face of impending disaster. A storage container, for example a drawer, is provided with an inner lining. Valuables are stored in the lining within the drawer. The lining itself is an open carrier having side walls which are folded so as to configure the liner to the drawer. In the case of emergency evacuation, the side walls of the liner are rapidly unfolded by grasping draw strings which act to remove the liner from the drawer and to close the liner to provide a closed transport carrier for the valuables stored within the drawer.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, THAT WHICH IS CLAIMED IS:

1. A removable, portable liner for a drawer, for rapid removal and transport of drawer contents, comprising:

a flexible, closable, open top carrier having a bottom and an enclosing wall; said enclosing wall having interior and exterior surfaces; said bottom having a selected length and width for conforming to the bottom of the drawer to be lined by said carrier; said enclosing wall of said carrier having a height adapted to be selected to extend beyond the top of the side walls of said drawer to be lined by said carrier;

folds in said enclosing wall of said carrier adapted to foldingly reduce said height of said enclosing wall below the height of said side walls of said drawer when said drawer is lined by said carrier and adapted to form a portion of said interior surface of said enclosing wall which faces outwardly; and coupling means attached to that portion of said interior surface which is adaptable to face outwardly and adapted to coact with complementary coupling means mounted on the interiors of said side walls of said drawer for releasably coupling said enclosing wall to said side walls of said drawer and for maintaining said carrier top open when said drawer is lined by said carrier.

2. The removable, portable drawer liner of claim 1 wherein said open top of said carrier includes closure means for closing said open top of said carrier about any contents disposed therein.

3. The removable, portable drawer liner of claim 2 wherein said closure means includes means for rapidly releasing said coupling means to decouple said enclosing wall of said carrier from said side wall of said drawer while closing said open top of said carrier.

4. The removable, portable drawer liner of claim 3 wherein said closure means is a draw string closure.

5. A system for rapid evacuation of storage container contents comprising:

a storage container in which valuables are stored and accumulated, said storage container having sidewalls and a bottom;

a flexible, closable, open top carrier lining the interior of said container and bearing said stored and accumulated valuables; said open top carrier having a bottom and an enclosing wall; said enclosing wall having interior and exterior surfaces; said bottom of said carrier having a selected length and width for conforming to the bottom of said storage container; said enclosing wall of said carrier having a height adapted to be selected to extend beyond the top of the side walls of said storage container;

folds in said enclosing wall of said carrier adapted to foldingly reduce said height of said enclosing wall below the height of said side walls of said storage container when said storage container is lined by said carrier and adapted to form a portion of said interior surface of said enclosing wall which faces outwardly;

coupling means attached to said portion of said interior surface which is adaptable to face outwardly and adapted to coact with complementary coupling means mounted on the interiors of said side walls of said storage container for releasably coupling said enclosing wall to said side walls of said storage container and for maintaining said carrier top open when said storage container is lined by said carrier; and means coupled to said carrier for rapidly closing said open top carrier and removing said carrier from said storage container with said valuables secured for transport within said carrier.

6. The system of claim 5 wherein said storage container is a drawer.

7. The system of claim 5 wherein:

said carrier has interior dimensions generally exceeding the interior dimensions of said storage container.

8. The system of claim 7 wherein said storage container is a drawer.

9. The system of claim 7 wherein:

said carrier is a closable, open top sack having an enclosing wall and a bottom;

said storage container has a support surface for supporting said valuables therein; and said bottom of said sack has a shape generally conforming to the shape and size of said support surface.

10. The system of claim 9 wherein:

said means for rapidly closing said open top carrier comprises a draw string encompassing the open top of said sack for drawing said open top closed and for lifting said sack from said storage container with said valuables within said sack.

11. The system of claim 9 wherein:

said enclosing wall of said sack has a height exceeding the height of said side walls of said storage container.

12. The system of claim 11 wherein said storage container is a drawer.

13. The system of claim 11 wherein:

said means for rapidly closing said open top carrier comprises a draw string encompassing the open top of said sack for drawing said open top closed and for lifting said sack from said storage container with said valuables within said sack.

14. The system of claim 13 wherein said storage container is a drawer.

15. The system of claim 5 wherein:

said means for rapidly closing said open top carrier comprises a draw string encompassing the open top of said carrier for drawing said open top closed and for lifting said carrier from said storage container with said valuables within said carrier.

16. The system of claim 15 wherein said storage container is a drawer.

17. The system of claim 16 wherein:

said carrier is a closable, open top sack having an enclosing wall and a bottom;

said storage container has a support surface for supporting said valuables therein; and said bottom of said sack has a shape generally conforming to the shape and size of said support surface.

* * * * *